US006334239B1

(12) United States Patent
Kraut

(10) Patent No.: US 6,334,239 B1
(45) Date of Patent: Jan. 1, 2002

(54) KEY HOLDER

(76) Inventor: Herman H. Kraut, 14 Bailey Rd., Fairfield, CT (US) 06432

( * ) Notice: Subject to any disclaimer, the term of this patent is extended or adjusted under 35 U.S.C. 154(b) by 0 days.

(21) Appl. No.: 09/625,665

(22) Filed: Jul. 26, 2000

(51) Int. Cl.[7] ..... A44B 15/00
(52) U.S. Cl. ..... 24/3.6; 24/3.1
(58) Field of Search ..... 24/3.11, 3.1, 3.12, 24/3.6, 3.13; 281/44, 51; 206/37.1–37.8; 224/269, 666, 669, 670; 70/456 R, 456 B; D3/208

(56) References Cited

U.S. PATENT DOCUMENTS

| | | | | |
|---|---|---|---|---|
| D15,367 | S | | 12/1884 | Moore |
| 1,110,760 | A | | 9/1914 | Easton |
| 1,155,296 | A | * | 9/1915 | Beuther |
| 1,281,656 | A | * | 10/1918 | Raschick |
| 1,283,557 | A | * | 11/1918 | Raschick |
| 1,368,156 | A | | 2/1921 | Jackson |
| 2,457,195 | A | | 12/1948 | Bagnall, Jr. |
| 2,571,609 | A | * | 10/1951 | Powell |
| 2,572,703 | A | * | 10/1951 | Dennis |
| 3,886,773 | A | * | 6/1975 | McGahee |
| 3,934,317 | A | * | 1/1976 | Langwell |
| 4,226,105 | A | * | 10/1980 | Wehrman |
| 5,183,153 | A | * | 2/1993 | Linn |
| 5,615,454 | A | | 4/1997 | Contarino |
| 5,950,816 | A | | 9/1999 | Reid ..... |

* cited by examiner

*Primary Examiner*—James R. Brittain
(74) *Attorney, Agent, or Firm*—Fattibene & Fattibene; Arthur T. Fattibene; Paul A. Fattibene

(57) ABSTRACT

This disclosure is directed to a key and memo pad holder which includes a garment clip in the form of an alligator clip having a bar like jaw to which a main key loop is detachably connected. The main key loop includes a slidably disposed sleeve on one end to form a closure, and one or more variously sized auxiliary split key rings on said main key loop to accommodate keys having different size key openings. Detachably connected to the main key loop is a miniature memo pad having a plurality of pages for jotting thereon desired notes or memos. The arrangement of the memo pad is such that the pages, in the inoperative position, are maintained in alignment by an elastic band, and which main loop and memo pad are rendered separately and independently detachable from the garment clip.

7 Claims, 1 Drawing Sheet

KEY HOLDER

FIELD OF INVENTION

This invention relates generally to a key holder and more specifically to a combination key and memo pad holder.

BACKGROUND OF THE INVENTION

Heretofore, various forms of key holders are known, as evidenced by U.S. Pat. Nos. 5,950,816; 2,457,195; 1,368,156; 1,110,760 and Design Patent D153,677. U.S. Pat. No. 5,615,454 is noted as being applicable for use as a holder for magnetic encoded cards, e.g. casino complementary cards, credit cards or pass key cards for unlocking doors. Undoubtedly, many other types of key holders are known which include for the most part merely decorable fob of some type, e.g. small plaque, a logo advertising a given product, or a miniature utilitarian device such as a small knife, nail clipper or the like having connected thereto a ring for holding one or more keys.

SUMMARY OF THE INVENTION

An object of this invention is to provide a key holder which can be readily worn on the exterior or interior of one's garment.

Another object is to provide a combination key and small memo pad which is light and comfortable to carry.

Another object is to provide a key holder having a garment attachment clip and attached key ring whereby the key ring is rendered readily detachable from the garment clip.

Another object is to provide a combination key and memo pad holder having a connected key ring which can be readily clipped to one's garment, and constructed so that either the key ring and/or memo pad are rendered independently detachable.

Another object is to provide a key holder having detachably connected thereto a miniature pad which one can use to retain relevant information.

Another object of the invention is to provide a combination key and memo pad holder having a plurality of cards or pages whereby the cards or pages are neatly maintained in an aligned relationship until needed.

Another object is to provide a combination key and card holder wherein a plurality of cards or pages are supported thereon in a manner permitting the cards or pages to be fanned to view the information contained thereon from its inoperative aligned position.

The foregoing objects and other features and advantages are attained by a key holder having a garment attachment clip in the form of an alligator type gripper whereby the key holder can be readily attached either on the exterior or interior of one's garment. Connected in series to the alligator clip is a main "C shaped" key loop whereby the opening between the opposed ends of the main loop is closed by a locking sleeve slidably mounted on one end of the main loop which is adapted to be threaded to the other end of the main key loop to close the loop. The main key loop is sized to receive those keys formed with a relatively large opening or aperture. For supporting keys having relatively small or intermediate sized openings, there are provided a plurality of variably sized split rings which are carried on the main loop for accommodating such keys.

Connected to the main key loop through the medium of a readily quick disconnect hook is a memo pad having connected thereto a plurality of small cards or pages on which the user may jot brief notes, memos, and/or other useful information. The memo pad further includes an endless band to maintain the cards or pages in an aligned inoperative position. The cards or pages of the memo pad are retained in a manner which permits the cards or pages to be fanned so that the information thereon may be retrieved or read. The arrangement is such that either the main key loop and/or the memo pad may be independently detached from the alligator type clip at the will of the user.

IN THE DRAWINGS

DETAILED DESCRIPTION

Figure 1:
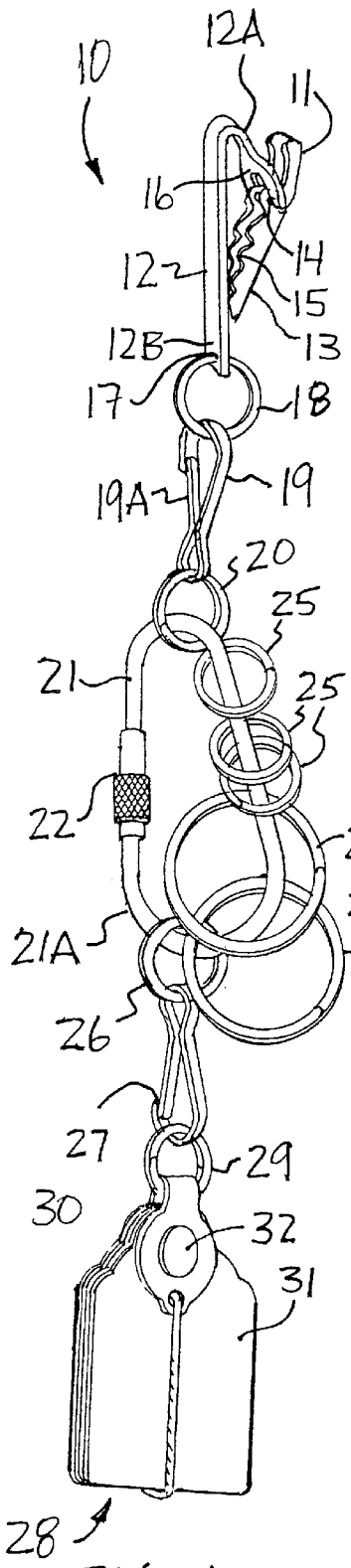
FIG. 1 is a perspective view of a key holder embodying the invention.
Figure 2:
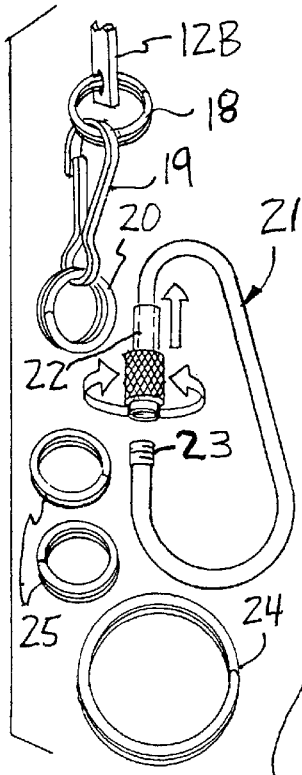
FIG. 2 is an exploded view of a main key loop assembly.

Referring to the drawing, there is illustrated in FIG. 1 a key holder 10 which embodies the present invention. Key holder 10 includes a means which is illustrated as an alligator type clip 11 having one jaw member 12 defined as a flat bar having one end 12A reversely bent at an acute angle relative to bar 12 to which the other jaw 13 is pivoted about pivot 14 located intermediate the opposed ends of jaw 13. The jaw 13 may be provided with a series of serrations 15 to provide a firm or positive gripping action. A pig tail spring 16 coiled about pivot 14 maintains the respective jaws 12 and 13 biased toward the normally closed position as seen in FIG. 1. Applying a force on the end 13A to overcome the bias of spring 16 urges the jaws toward the open position, and which jaws will normally be biased toward the closed position when the force thereon is removed.

In the illustrated embodiment, the end 12B of jaw 12 is provided with an aperture 17 through which a split connecting ring 18 is attached. Connected to the connecting ring 18 is a quick disconnect hook 19. As seen in FIG. 1, the quick disconnect hook 19 is provided with a flexible tang end 19A, which is normally biased toward a closed position whereby the free end of the tang end 19A is closed onto end 19B of hook 19. One end of the quick connect hook 19 is threaded through the connecting ring 18, and another connecting ring 20 is connected to the other end of hook 19.

A main key loop 21 is connected to connecting ring 20. In the illustrated embodiment, the main key loop 21 is defined as an elongated C-shaped member 21A, wherein the opposed ends are spaced apart from one another to provide an opening for placing the keys thereon. To secure the keys stored on the main key loop 21, a closing sleeve 22 is slidably and rotatably mounted on one end of the loop 21. The other end of the loop is provided with external threads 23. The corresponding end of sleeve 22 is internally threaded to mate with threads 23. Thus, to close the space or opening between the opposed ends of the main loop 21, the sleeve 22 is shifted to a closed position and rotated so that the internal threads of the sleeve 23 mate or thread onto the external threads 23 to close the loop 21. Thus, a means is provided to permit keys to be placed on or removed from the main key loop 21 and by which the keys are positively secured on the loop 21.

Also supported on the main loop 21 are a plurality of auxiliary split key rings. In the illustrated embodiment, two different sizes of auxiliary split key rings are shown, e.g. an intermediate size auxiliary split ring 24 and a small size auxiliary split ring 25. While only two sizes of auxiliary split ring sizes are shown, it will be understood the number of various sizes of auxiliary split rings may vary.

It is to be noted that the outside diameter of the main key loop 21, and the respective auxiliary key rings 24 and 25, vary. Thus, keys having large size apertures formed thereon can be readily stowed on the main loop 21. Keys having a smaller size aperture therein may be stowed on either the auxiliary split rings 24 or 25 accordingly.

Loop 21 also has connected thereto a second split connecting ring 26 to which there is attached another quick disconnect hook 27 similar to hook 19, hereinbefore described. Connected to hook 27 is a memo pad holder 28.

Figure 3:
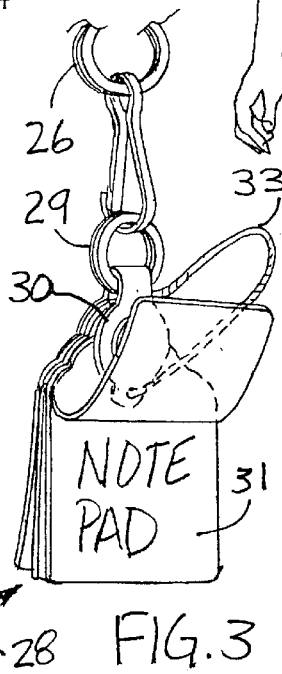
FIG. 3 is a detail perspective view of the memo pad holder.
Figure 4:
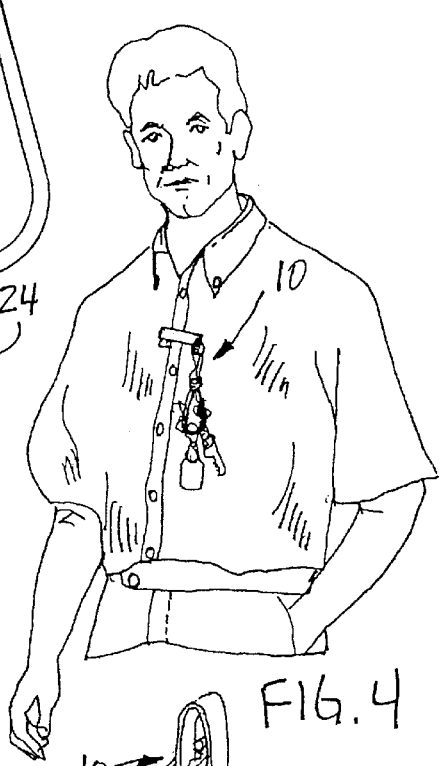
FIGS. 4 and 5 are perspective views illustrating various uses of the instant invention.
Figure 5:
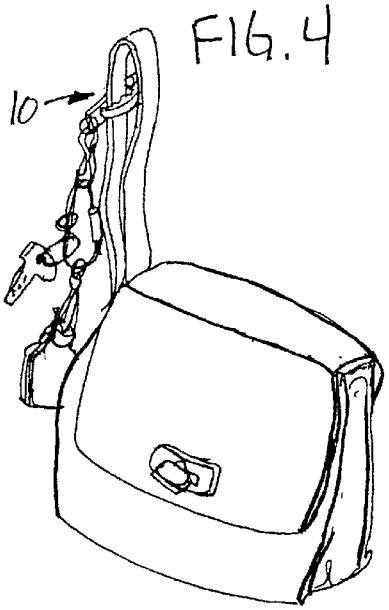

The memo pad holder 28 includes a connecting ring 29 which is supported on hook 27. Reversely folded about the connecting ring 29 is reversely bent saddle 30 for supporting between the opposed sides thereof a plurality of miniature cards or pages 31. The cards or pages 31 may be blank, which the user may use to jot notes, memos, telephone numbers, addresses, or any other information desired. The cards or pages 31 are retained between the opposed sides of saddle 30 by means of a pin, e.g. a rivet or cotter pin 32. A means is provided to maintain the card or pages in an aligned position. In the illustrated embodiment, the means includes an elastic band 33 which is attached to the saddle 30 whereby the elastic band 33 may be readily looped about the cards or pages 31 to maintain the cards or pages 31 in the aligned inoperative position as seen in FIG. 1. To retrieve the information contained on the cards, the elastic band 33 is shifted to one side so that the cards 31 may be readily fanned or turned up as shown in FIG. 3, to thereby reveal the information contained thereon.

From the foregoing, it will be apparent that the alligator type bar clip 11 can be clipped to virtually any type of material, from thick to thin, and allows the key holder 10 to be secured to the inside of pants and jacket pockets. This allows the keys to be suspended inside the pocket, and unlike other key holders, solves the problem of the keys all bunching uncomfortably, and annoyingly, at the bottom of a pocket. The clip 11 also allows the key holder 10 to be conveniently worn on a waistband or belt, or clipped to the inside of a pocketbook, making it easy to find the keys.

When the key holder 10 is worn on a waistband with a belt over it, the snap disconnect hook 19 allows the key loop to be disconnected or reconnected directly to and from the alligator clip assembly without having to open the belt to remove the alligator clip/key ring assembly. The alligator clip 11 conveniently stays under the belt.

The slide locking mechanism of the key loop 21 not only keeps the keys on the loop very securely, but also allows for easy key entry or exit, and for easy organization of the keys thereon. Further, any individual key can be easily taken off the loop 21 simply by using the lock mechanism instead of a hard to open, nail-breaking, non-screw lock based key ring. Since keys are placed directly on the key loop, intermediate and smaller split rings are provided to which keys having smaller holes may be connected or carried thereon, or for some bulky car keys that can then be placed directly on the main key loop. The built-in memo pad holder 28 with miniature, refillable cards or pages provides a means for jotting a quick note, memo, message, etc. The cards or pages can be maintained in an aligned position, or can be fanned out to view the messages or notes thereon, or to write new messages, without fumbling with, or trying to find a piece of paper. The card note holder also has the quick-release snap hook feature, so that one can write or view notes, with the memo pad holder detached from the main key loop 21.

While the present invention has been described with respect to a particular embodiment, modifications and variations may be made without departing from the spirit or scope of this invention.

What is claimed is:

1. A key holder comprising:

a garment attachment clip, a main key loop detachably connected to said garment clip, variable sized auxiliary split key rings supported on said main loop sized to accommodate keys having an opening incapable of being accommodated on said main loop, and a miniature pad detachably connected to said main loop.

2. A key holder as defined in claim 1 wherein said garment clip comprises an alligator type gripper having a pair of jaws, one of said jaws formed as a flat bar reversely bent at one end to define an acute angle, and the other of said jaws being pivotally connected to said reversely bent end, and a spring normally biasing said jaws toward a closed position.

3. A key holder as defined in claim 2 wherein said main key loop comprises:

a generally "C" shaped member having spaced apart aligned end portions to define an opening for effecting the placement and removal of keys onto said main loop, a closure sleeve slidably mounted on one aligned end portion of said "C" shaped member, and the other aligned end portion of said "C" shaped member having external threads thereon, said closure sleeve having complementary internal threads adapted to mate with said external threads to close the space between said aligned end portions.

4. A key holder as defined in claim 3 and including a quick disconnect hook for detachably connecting said main key loop to the free end of said flat bar.

5. A key holder as defined in claim 1 wherein said miniature pad comprises a pad holder, said pad holder defining a U-shaped saddle having opposed spaced apart sides, an aligned aperture formed in each of said spaced apart sides, a plurality of miniature pages disposed between said opposed sides, a fastener extended through said aligned apertures and said pages disposed therebetween, and a band connected to said saddle for circumscribing said pages to maintain said pages in an aligned inoperative position.

6. A key holder as defined in claim 5 and including a quick disconnect hook detachably connecting said miniature pad from said main key loop.

7. A combination key and miniature pad holder comprising:

a garment clip, said garment clip including having a pair of jaws, one of said jaws constituting a flat bar having a reversely bent end portion to define an acute angle and the other of said jaws being pivotally mounted on said reversely bent end portion at a point intermediate the ends of said other of said jaws, a spring biasing said jaws toward a normally closed position, a main key loop connected to said garment clip, said main key loop having a generally C shaped configuration having opposed spaced apart end portions to define an opening for effecting the placement of keys onto and off said main key loop, a closure sleeve slidably mounted on one of said opposed end portions, and the other end portion having external threads thereon, said closure sleeve having internal threads for mating with said external threads in the closed position of said closure sleeve, a plurality of split key rings mounted on said main key loop, said plurality of split key rings including split key rings of variable sizes for accommodating keys having variably sized key ring openings therein, and a miniature pad connected to said main key loop, said miniature pad including a reversely bent member defining a saddle having opposed sides, each of said opposed sides having an aligned aperture, a plurality of miniature pages disposed between said walls of said saddle, a fastener extended through said aligned apertures and pages disposed between said opposed sides of said saddle, and a band connected to said saddle and adapted to circumscribe said pages for maintaining said pages in aligned inoperative position, means for effecting a quick disconnect between said main loop and garment clip, and a second means for effecting a quick disconnect between said miniature pad and said main loop.

* * * * *